US010472159B2

(12) United States Patent
Luchak

(10) Patent No.: US 10,472,159 B2
(45) Date of Patent: Nov. 12, 2019

(54) BEVERAGE CONTAINER INSULATOR

(71) Applicant: Peter W. Luchak, London (CA)

(72) Inventor: Peter W. Luchak, London (CA)

( * ) Notice: Subject to any disclaimer, the term of this patent is extended or adjusted under 35 U.S.C. 154(b) by 0 days.

(21) Appl. No.: 16/158,617

(22) Filed: Oct. 12, 2018

(65) Prior Publication Data

US 2019/0135522 A1 May 9, 2019

Related U.S. Application Data

(63) Continuation-in-part of application No. 15/975,215, filed on May 9, 2018, now Pat. No. 10,183,799.

(60) Provisional application No. 62/582,087, filed on Nov. 6, 2017.

(51) Int. Cl.
*B65D 81/38* (2006.01)
*B65D 25/22* (2006.01)

(52) U.S. Cl.
CPC ..... *B65D 81/3876* (2013.01); *B65D 25/22* (2013.01); *B65D 2203/02* (2013.01)

(58) Field of Classification Search
CPC ..... B65D 81/3879; B65D 81/3876; B65D 81/38; B65D 3/22; B65D 25/22; B65D 25/20
USPC ..... 220/739, 737, 592.26, 903, 601, 694; 229/403; 215/395, 386; 40/310, 306; 206/459.5
See application file for complete search history.

(56) References Cited

U.S. PATENT DOCUMENTS

| | | | | |
|---|---|---|---|---|
| 4,540,611 | A | 9/1985 | Henderson | |
| 4,648,525 | A * | 3/1987 | Henderson | B65D 81/3886 215/395 |
| 2008/0047967 | A1* | 2/2008 | Brunner | B65D 81/3886 220/737 |
| 2008/0164269 | A1 | 7/2008 | Vorderkunz | |
| 2009/0294317 | A1 | 12/2009 | Villhard, Jr. | |
| 2010/0130339 | A1 | 5/2010 | Junkins | |
| 2011/0079602 | A1* | 4/2011 | O'Malley | B65D 81/3876 220/739 |

FOREIGN PATENT DOCUMENTS

WO 2007134377 A1 11/2007

* cited by examiner

*Primary Examiner* — Robert J Hicks
(74) *Attorney, Agent, or Firm* — Black, McCuskey, Souers & Arbaugh LPA

(57) ABSTRACT

A beverage container insulator is disclosed herein and can include a body defining a cylinder with an opening at a first end and a web closing a second end. An interior surface defined by the body can receive a beverage container. An exterior surface is defined by the body opposite to the interior surface. The beverage container insulator can also include a first pattern of indicia positioned on the exterior surface. The first pattern forms readable text oriented such that a bottom edge of the readable text positioned closer to the web than the opening. The beverage container insulator can also include a second pattern of indicia positioned on the interior surface. The second pattern forms readable text oriented such that a bottom edge of the readable text is positioned closer to the opening than the web.

7 Claims, 5 Drawing Sheets

BEVERAGE CONTAINER INSULATOR

CROSS-REFERENCE TO RELATED APPLICATIONS

This application is a continuation-in-part of U.S. patent application Ser. No. 15/975,215 for a BEVERAGE CONTAINER INSULATOR, filed on May 9, 2018, which is hereby incorporated by reference in its entirety. This application also claims the benefit of U.S. Provisional Patent Application Ser. No. 62/582,087 for a FOLD DOWN BEVERAGE INSULATOR SYSTEM, filed on Nov. 6, 2017, which is hereby incorporated by reference in its entirety.

BACKGROUND

1. Field

The present disclosure relates to insulating sleeves or jackets for cans, bottles, barrels, etc, as found in B65D 81/3876 of the Cooperative Patent Classification system.

2. Description of Related Prior Art

U.S. Pub. No. 2012/0243808 discloses INSULATED LINERS AND CONTAINERS. An insulated shipping liner includes a flexible sealed sack having a first layer and second layer sealed together about their outer peripheral edges to form a housing. An insulating layer made from a single sheet of foam material is located within the housing and is configured to be folded such that a first side portion, second side portion and middle portion create a substantially rectangular box form, with the first and second side portions defining opposing sides of the box form, the middle portion defining a bottom of the box form, the substantially rectangular top flap defining at least part of a top of the box form, and the opposing substantially rectangular first and second side flaps defining at least part of other opposing sides of the box form. The box form can be placed in a container to form an insulated container for shipping and/or storage.

U.S. Pat. No. 4,540,611 discloses a FOLD-UP INSULATED BEVERAGE CONTAINER HOLDER. The '611 patent discloses a one piece beverage insulator in the form of a beverage container holder with an open top that is die cut from a sheet of insulative foam either open cell or closed cell laminated with a surface vinyl film. The one piece beverage insulator die cut pattern is in the form of two mirror image side halves joined by a center bottom shaped to conform to the bottom of a beverage container to be held by the finished holder. The die cut holder pattern is folded over on itself with the side halves aligned but with the inside foam sides of the halves facing out and the side edges are stitched or vinyl welded together after which the holder is pulled inside out through its open top returning the vinyl surface to the outside. This finished holder is stored in a collapsed flat state to be opened when receiving a beverage can or other beverage container to be held and insulated by the holder.

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

SUMMARY

A beverage container insulator can include a body defining a cylinder and having an opening at a first end and a web closing a second end opposite the first end. An interior surface can be defined by said body and can be configured to receive a beverage container. An exterior surface can be defined by the body opposite to the interior surface. The beverage container insulator can also include a first pattern of indicia positioned on the exterior surface. The first pattern of indicia forms readable text oriented such that a bottom edge of the readable text is positioned closer to the web than the opening. The beverage container insulator can also include a second pattern of indicia positioned on the interior surface. The second pattern of indicia forms readable text oriented such that a bottom edge of the readable text is positioned closer to the opening than the web.

BRIEF DESCRIPTION OF THE DRAWINGS

The detailed description set forth below references the following drawings.

DETAILED DESCRIPTION

Figure 1:
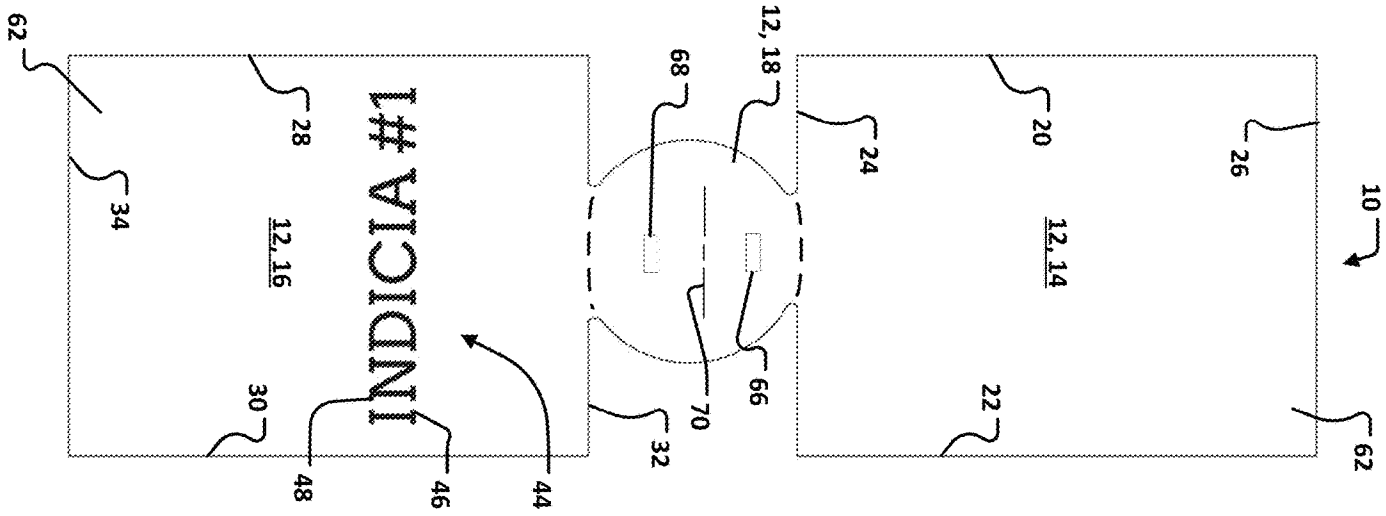
FIG. 1 is a top view of a blank that can be used to form an exemplary embodiment of the present disclosure.

The present disclosure provides a beverage container insulator that substantially departs conventional concepts and designs. The present disclosure provides an article of manufacture configured to receive a beverage container and thermally insulate the beverage container. But further, the present disclosure provides an article of manufacture bearing a first set of indicia on an outside surface and a second set of indicia on an inside surface. The first set of indicia can convey a first message and the second set of indicia can convey a second message. The present disclosure provides an article of manufacture that can insulate a beverage container in a safe, convenient, and economical manner.

In view of the disadvantages inherent in the known types of beverage insulators of known designs and configurations now present in the prior art, the present disclosure provides an improved beverage container insulator. As such, the general purpose of the present disclosure, which will be described subsequently in greater detail, is to provide a new and improved beverage container insulator which has all the advantages of the prior art and none of the disadvantages. In this respect, before explaining at least one embodiment of the present disclosure in detail, it is to be understood that the present disclosure is not limited in its application to the details of construction and to the arrangements of the exemplary embodiment set forth in the following description or illustrated in the drawings. Other embodiments of the present disclosure are capable of being practiced and carried out in various ways. Also, it is to be understood that the phraseology and terminology employed herein are for the purpose of descriptions and should not be regarded as limiting.

With reference now to the drawings, an embodiment of the present disclosure is defined by beverage container insulator 10. The exemplary beverage container insulator 10 includes a blank 12 of material. The exemplary blank 12 can be formed from neoprene. The blank 12 can be formed from other materials in other embodiments, such from a woven fabric, open cell foam, paper, rubber or silicone. An elastomeric material is a polymer with both viscosity and elasticity and relatively weak inter-molecular forces, generally having low Young's modulus and high failure strain compared with other materials. An elastomeric material displays rubber-like elasticity. Alternatively, the blank 12 can be formed from a combination of materials, including a layer of elastomeric material and a layer of fabric.

The exemplary blank 12 includes a first panel portion 14, a second panel portion 16, and a web 18 interconnecting the panel portions 14, 16. The first panel portion 14 extends between opposite edges 20, 22 and also between opposite edges 24, 26. The second panel portion 16 extends between opposite edges 28, 30 and also between opposite edges 32, 34. The web 18 extends between opposite edges 24 and 32. The web 18 is interconnected to the panel portion 14 along the edge 24. The web 18 is interconnected to the panel portion 16 along the edge 32.

Figure 5:
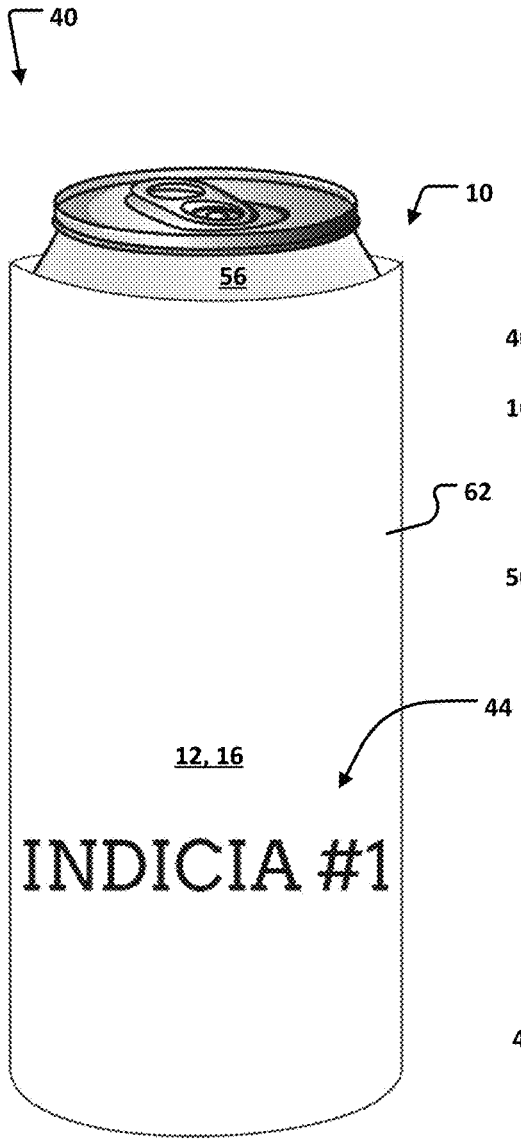
FIG. 5 is a perspective view of the beverage container insulator mounted on a beverage container and arranged in the first configuration (unfolded)
Figure 6:
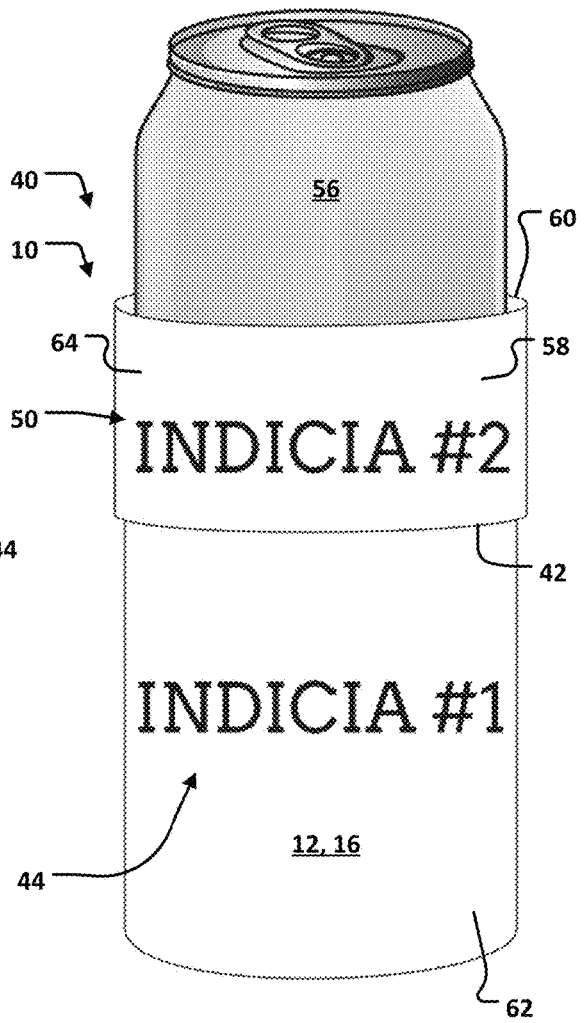
FIG. 6 is a perspective view of the beverage container insulator mounted on the beverage container and arranged in the second configuration (folded)
Figure 7:
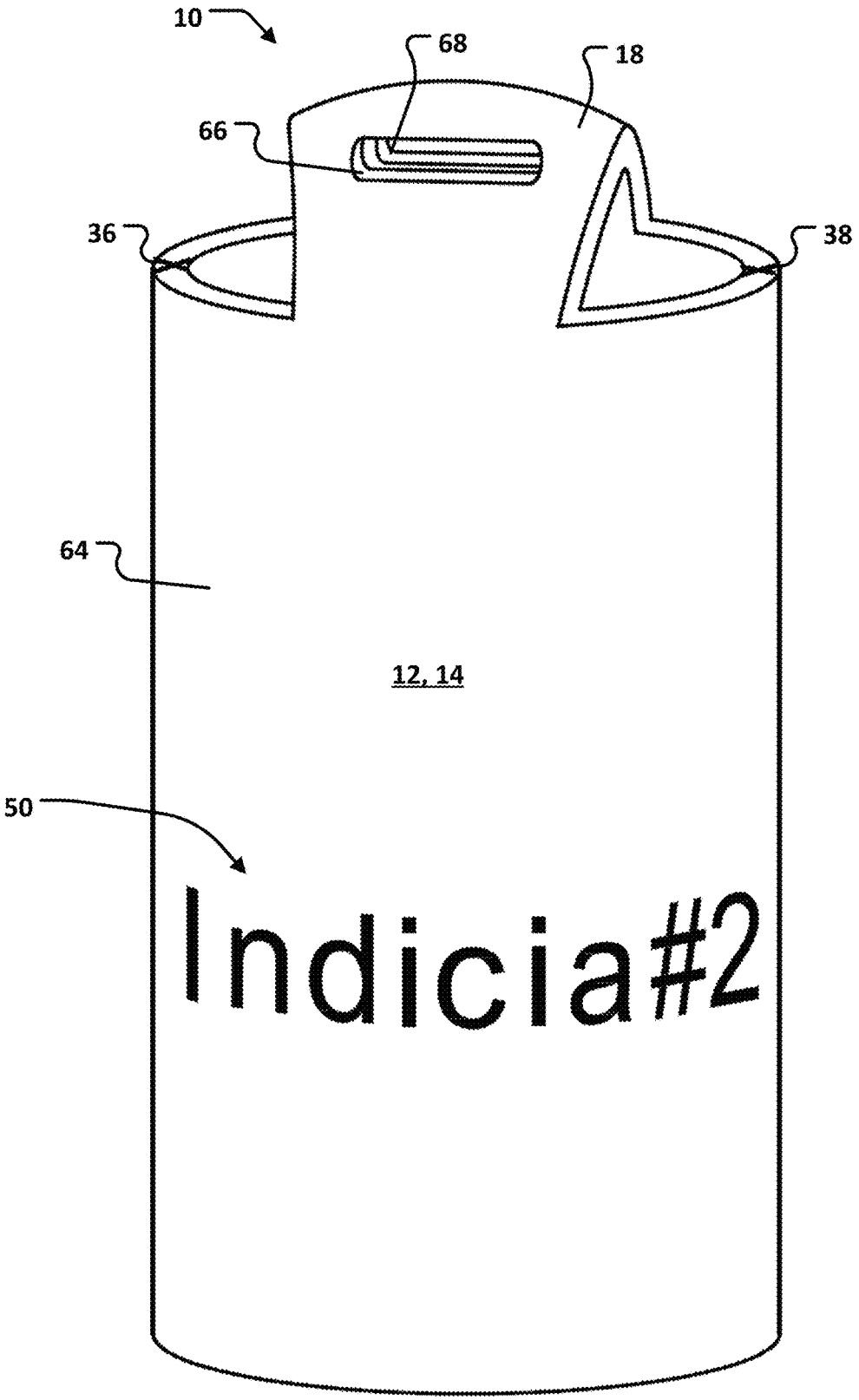
FIG. 7 is a perspective view of the beverage container insulator arranged inside-out for a further use.
Figure 8D:
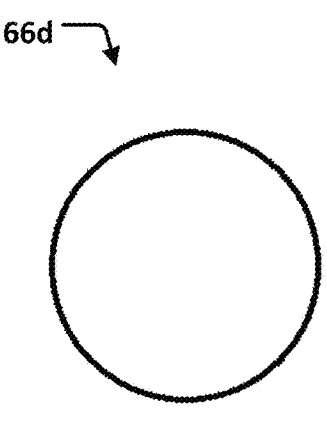
FIG. 8A-8D show various perimeters for apertures in the beverage container insulator.
Figure 8C:
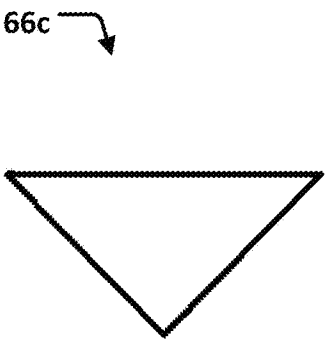
Figure 8B:
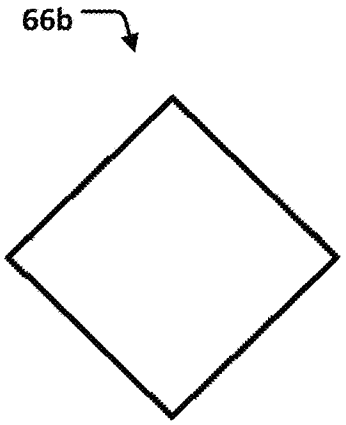
Figure 8A:
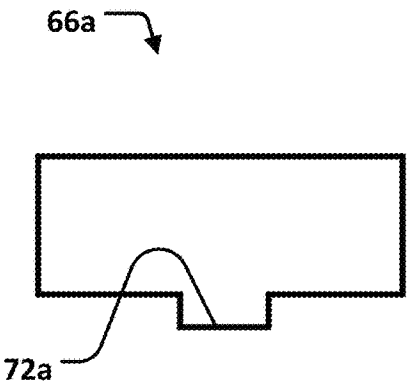

A top surface 62 of the exemplary blank 12 that is visible in FIG. 1 can define an exterior or outside surface of the beverage container insulator 10, as shown in FIG. 5. A bottom surface 64 of the exemplary blank 12 that is visible in FIG. 2 can define an interior surface of the beverage container insulator 10, as shown in FIG. 6. FIG. 7 shows that the beverage container insulator 10 drawn "inside-out."

Figure 4:
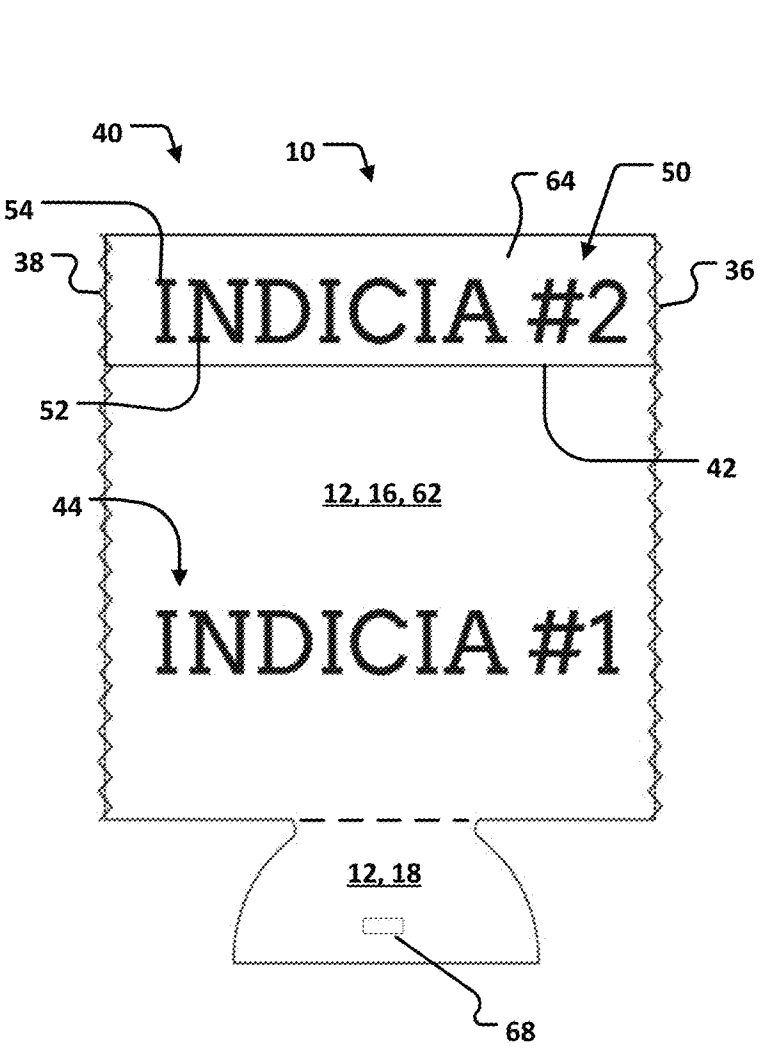
FIG. 4 is a front view of the beverage container insulator formed from the blank shown in FIGS. 1 and 2 wherein the beverage container insulator is arranged in a second configuration.
Figure 3:
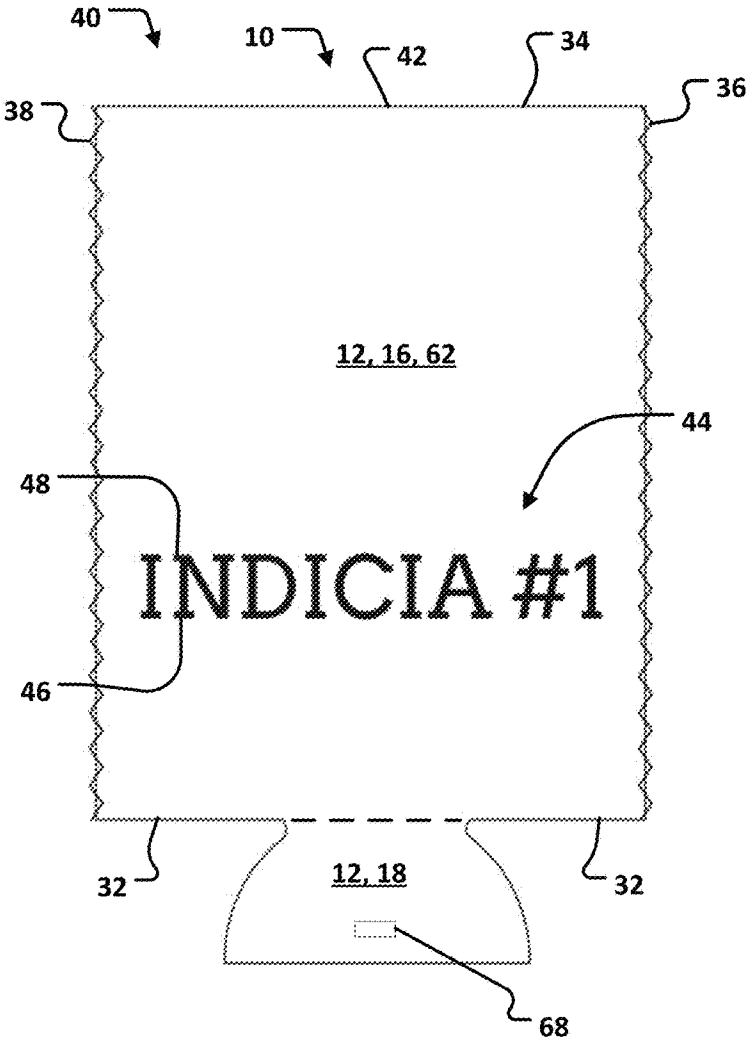
FIG. 3 is a front view of a beverage container insulator formed from the blank shown in FIGS. 1 and 2 wherein the beverage container insulator is arranged in a first configuration.

FIGS. 3 and 4 show the blank 12 further processed to form a generally cylindrical shape. The exemplary edges 20 and 28 have been fixed together with stitching 36. The exemplary edges 22 and 30 have been fixed together with stitching 38. In FIGS. 3 and 4, the beverage container insulator 10 has flattened so that one-half of the web 18 is visible. In operation, the web 18 would be flat and define a partially-closed bottom of the cylinder defined by the stitched-together panel portions 14, 16. Fold lines are represented by dashed lines in the Figures. It is noted that the stitching has been omitted in FIGS. 5 and 6 to enhance the clarity of the other structures.

Figure 2:
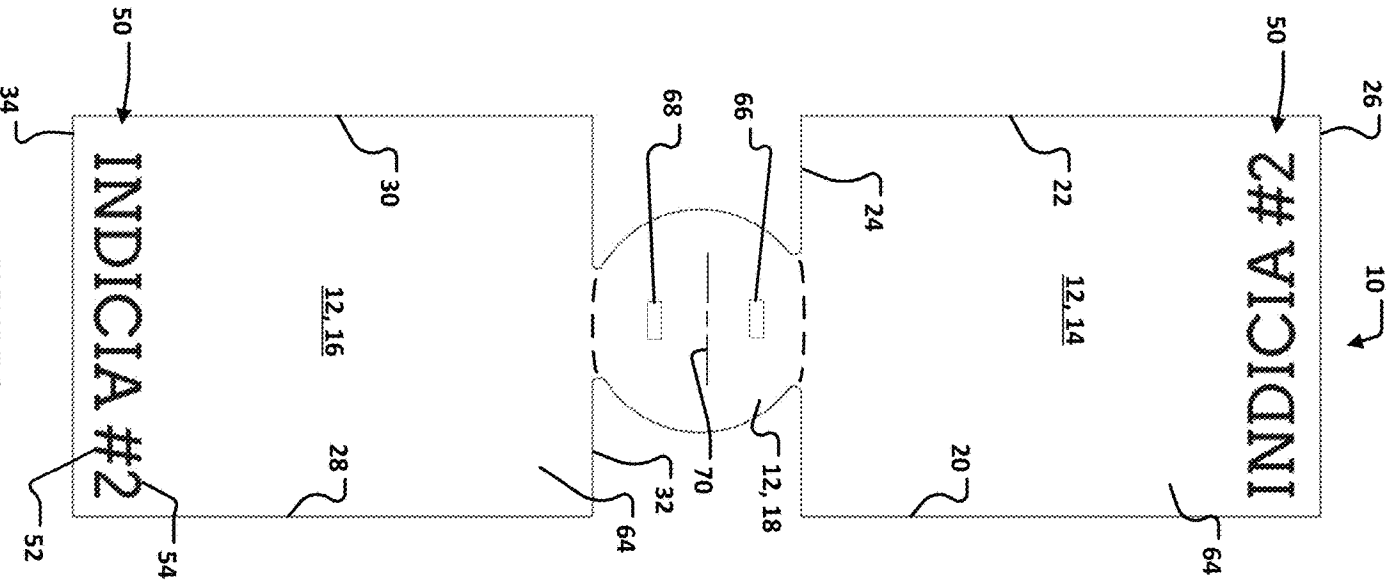
FIG. 2 is a bottom view of the blank shown in FIG. 1.

The panel portions 14, 16 and web 18 thus form a body 40 of the beverage container insulator 10. The exemplary body 40 is generally cylindrical, but could be shaped differently in other embodiments of the present disclosure. The surfaces visible in FIG. 2 shows interior surfaces of the generally-cylindrical body 40. The interior surfaces defined by the body 40 receive and contact the beverage container when the beverage container insulator 10 is in use. FIG. 1 shows exterior surfaces of the generally-cylindrical body 40. The exterior surfaces are opposite of the interior surfaces relative to the body 40.

The edges 26 and 34 cooperate to define an opening 42 of the interior of the generally-cylindrical body 40. A beverage container can be received into the body 40 through the opening 42. The web 18 defines a closed end of the interior of the generally-cylindrical body 40. A beverage container can rest on the web 18 after being received through the opening 42, while encircled by the panel portions 14, 16.

The beverage container insulator 10 also includes a first pattern 44 of indicia. The first pattern 44 of indicia is positioned on the exterior surface of body. The first pattern 44 of indicia forms readable text oriented such that a bottom edge 46 of the readable text is positioned closer to the web 18 than the opening 42. A top edge 48 of the exemplary readable text of the first pattern 44 of indicia is positioned closer to the web 18 than the opening 42. It is noted that multiple patterns of indicia can be positioned on the surface visible in FIG. 1.

The beverage container insulator 10 also includes a second pattern 50 of indicia positioned on the interior surface. The second pattern 50 of indicia forms readable text oriented such that a bottom edge 52 of the readable text is positioned closer to the opening 42 than the web 18. A top edge 54 of the readable text of the second pattern 50 of indicia is positioned closer to the opening 42 than the web 18.

As shown in FIG. 5, in operation, a beverage container insulator 10 can receive a beverage container 56 through the opening 42. The beverage container 56 can rest on the web 18 and be encircled by the panels 14, 16. The first pattern 44 of indicia forms readable text on the exterior surface of the body 40.

As shown in FIG. 6, in operation, the top end of the body 40 can then be folded over, or cuffed. A cuffed or folded-over portion of the body 40 is referenced at 58. The second pattern 50 of indicia forms readable text that is exposed on the cuffed portion 58 of the body 40. Both of the exemplary first and second panel portions 14, 16 are configured to fold-over whereby both of the first and second patterns 44, 50 of indicia can be concurrently exposed and concurrently readable.

The beverage container insulator 10 does not merely serve as a support for the first and second patterns 44, 50 of indicia. The respective, readable text defined by the first and second patterns 44, 50 of indicia are directed towards conveying a message or meaning to a human reader relevant to the beverage container. In one embodiment, the readable text of the first pattern 44 of indicia and the readable text of the second pattern 50 of indicia can convey different kinds of drinks. For example, the readable text of the first pattern 44 of indicia can display "SODA" or "COFFEE" and the readable text of the second pattern 50 of indicia can display "DIET" or "DECAF." In this way, a common beverage container insulator 10 can be utilized to insulate different kinds of beverages and advise the user of the particular beverage being insulated. The user will see "SODA" if the beverage is soda and the beverage container insulator 10 is not folded-over. Another user preferring diet soda can select a beverage being insulated by the beverage container insulator 10 when folded over so that the words "DIET" and "SODA" are visible.

In another example, the cuffed portion 58 could extend sufficiently long to cover the first pattern 44 of indicia. The readable text of the first pattern 44 of indicia can display "COLA" and the readable text of the second pattern 50 of indicia can display "ROOT BEER." The person loading the beverage container 56 in the beverage container insulator 10 can fold the opening over as necessary, based on the contents of the beverage container. Again, a single beverage container insulator 10 can be utilized for different kinds of beverages.

In yet another example demonstrating a functional relationship, in one or more embodiments of the present disclosure, the readable text of the first pattern 44 of indicia can convey a kind of beverage and the readable text of the second pattern 50 of indicia can convey nutritional information about the beverage. Further, the second pattern 50 of indicia can include horizontal lines that can be aligned with the level of the beverage in the container. For example, user can fold the body 40 over until a top edge 60 (see FIG. 6) of the cuffed portion 58 is aligned with the level of the beverage in the beverage container. The second pattern 50 of indicia can be arranged so that when this occurs that readable text informs the user of the quantity of the beverage consumed, the quantity of the beverage remaining, and/or the nutritional attributes of either quantity.

The exemplary beverage container insulator 10 also includes first and second apertures 66, 68. The exemplary first and second apertures 66, 68 are formed in the web 18. The exemplary first and second apertures 66, 68 are arranged to mirror one another on opposite sides of an axis passing through a middle of the web. This is shown in FIGS. 1 and 2 and the axis is referenced at 70.

The exemplary body 40 is configured to be selectively drawn inside-out and right-side-in. FIGS. 3 and 5 show the body 40 in the right-side-in configuration. FIG. 7 is a perspective view of the beverage container insulator arranged inside-out for a further use. FIGS. 4 and 6 show the body 40 partially folded-over, which is a configuration between inside-out and right-side-in. When the body 40 is right-side-in, the interior surface 64 is encircled by the exterior surface 62. When the body 40 is inside-out, the interior surface 64 encircles the exterior surface 62.

The first and second apertures 66, 68 are alignable with one another when the body 40 is flattened or when the web 18 is not flat as shown in FIG. 7. A structure can be received in the apertures 66, 68 so that the beverage container insulator can be hung or suspended from another structure. For example, the beverage container insulator 10 can be placed on a hook mounted on a wall. Alternatively, the beverage container insulator 10 can be hung on a briefcase with a chain or plastic tie that passes through the apertures 66, 68.

The arrangement of the indicia provides yet another advantage when combined with the feature of the apertures 66, 68. For example, the second pattern of indicia 50 can be visible when the beverage container insulator 10 is suspended and is inside-out. The indicia 50 can convey information unrelated to the beverage that is insulated by the body 40, but information that relates to the structure from which the beverage container insulator 10 is being suspended. For example, the beverage container insulator 10 can be hung from a golf bag. The indicia 50 can be the name of the owner of the golf bag and the indicia 44 can identify the beverage being insulated.

The exemplary first and second apertures 66, 68 have a rectangular perimeter. However, in other embodiments of the present disclosure, the apertures can be shaped differently. FIG. 8A-8D show various perimeters for alternatively-shaped apertures for embodiments of the beverage container insulator. It is noted that the FIGS. 8A-8D show alternative embodiments of the aperture 66 and, while not shown, the adjacent aperture 68 could be shaped the same as each alternative embodiment of the aperture 66 (the axis 70 is also shown). Aperture 66*a* is partially rectangular and includes a notch portion 72*a*. The notch portion 72*a* can receive the tie or fastener or whatever structure is used to suspend the beverage container insulator 10, so that the orientation of the beverage container insulator 10 and the indicia can be better controlled. The aperture embodiments 66*b* and 66*c* define shapes that result in the beverage container insulator 10 hanging straight down while suspended. The aperture embodiment 66*d* defines a shape that accommodates more freedom of movement of the beverage container insulator 10 while suspended. It is noted that the apertures can be practiced in embodiments of the beverage container insulator 10 not having indicia.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein as other present disclosures in other patent documents is hereby unconditionally reserved.

What is claimed is:

1. A beverage container insulator comprising:

a body defining a cylinder and having an opening at a first end and a web closing a second end opposite said first end;

an interior surface defined by said body and configured to receive a beverage container;

an exterior surface defined by said body opposite to said interior surface;

a first pattern of indicia positioned on said exterior surface, said first pattern of indicia forming readable text oriented such that a bottom edge of said readable text is positioned closer to said web than said opening;

a second pattern of indicia positioned on said interior surface, said second pattern of indicia forming readable text oriented such that a bottom edge of said readable text is positioned closer to said opening than said web;

first and second panel portions of the body configured to fold over whereby both of said first and second patterns of indicia are concurrently exposed and concurrently readable;

said first and second patterns of indicia cooperate with one another to convey a message when said first and second panel portions are folded over; and first and second apertures formed in said web arranged to mirror one another on opposite sides of an axis passing through a middle of said web.

2. The beverage container insulator of claim 1 wherein a top edge of said readable text of said first pattern of indicia is positioned closer to said web than said opening.

3. The beverage container insulator of claim 2 wherein a top edge of said readable text of said second pattern of indicia is positioned closer to said opening than said web.

4. The beverage container insulator of claim 1 wherein said body is configured to be selectively drawn inside-out and right-side-in whereby, when right-side-in, said interior surface is encircled by said exterior surface and, when inside-out, said interior surface encircles said exterior surface.

5. The beverage container insulator of claim 1 wherein at least one of said first and second apertures have a rectangular perimeter.

6. The beverage container insulator of claim 1 wherein said first and second apertures are alignable with one another when said body is flattened.

7. The beverage container insulator of claim 1 wherein at least one of said first and second apertures have a circular perimeter.

* * * * *